US007949521B2

(12) United States Patent
Ehara et al.

(10) Patent No.: US 7,949,521 B2
(45) Date of Patent: May 24, 2011

(54) FIXED CODEBOOK SEARCHING APPARATUS AND FIXED CODEBOOK SEARCHING METHOD

(75) Inventors: Hiroyuki Ehara, Kanagawa (JP); Koji Yoshida, Kanagawa (JP)

(73) Assignee: Panasonic Corporation, Osaka (JP)

( * ) Notice: Subject to any disclaimer, the term of this patent is extended or adjusted under 35 U.S.C. 154(b) by 143 days.

(21) Appl. No.: 12/392,858

(22) Filed: Feb. 25, 2009

(65) Prior Publication Data

US 2009/0228266 A1 Sep. 10, 2009

Related U.S. Application Data

(63) Continuation of application No. 11/683,830, filed on Mar. 8, 2007, now Pat. No. 7,519,533.

(30) Foreign Application Priority Data

Mar. 10, 2006 (JP) ..... 2006-065399
Feb. 6, 2007 (JP) ..... 2007-027408

(51) Int. Cl.
*G10L 19/12* (2006.01)

(52) U.S. Cl. ..... 704/223; 704/219; 704/216; 704/222; 704/264

(58) Field of Classification Search ..... 704/219, 704/216, 222, 223, 264
See application file for complete search history.

(56) References Cited

U.S. PATENT DOCUMENTS 5,444,816 A 8/1995 Adoul et al.
5,596,676 A * 1/1997 Swaminathan et al. ..... 704/208
5,699,482 A 12/1997 Adoul et al.
5,701,392 A 12/1997 Adoul et al.
5,717,825 A 2/1998 Lamblin
5,754,976 A 5/1998 Adoul et al.
6,055,496 A 4/2000 Heidari et al.
6,826,527 B1 11/2004 Unno
6,829,579 B2 12/2004 Jabri et al.
7,184,953 B2 2/2007 Jabri et al.

(Continued)

FOREIGN PATENT DOCUMENTS

JP 10-502191 2/1998

(Continued)

OTHER PUBLICATIONS

Hagen et al., Removal of sparse-excitation artifacts in CELP, Acoustics, Speech, and Signal Processing, 1998, Proceedings of the 1998 IEEE International Conference, Seattle, WA, USA, May 12-15, 1998, vol. 1, May 1998, pp. 145-148.

(Continued)

*Primary Examiner* — Qi Han
(74) *Attorney, Agent, or Firm* — Greenblum & Bernstein, P.L.C.

(57) ABSTRACT

A fixed codebook searching apparatus which slightly suppresses an increase in the operation amount, even if the filter applied to the excitation pulse has the characteristic that it cannot be represented by a lower triangular matrix and realizes a quasi-optimal fixed codebook search. This fixed codebook searching apparatus is provided with an algebraic codebook that generates a pulse excitation vector; a convolution operation section that convolutes an impulse response of auditory weighted synthesis filter into an impulse response vector that has a value at negative times, to generate a second impulse response vector that has a value at second negative times; a matrix generating section that generates a Toeplitz-type convolution matrix by means of the second impulse response vector; and a convolution operation section that convolutes the matrix generated by matrix generating section into the pulse excitation vector generated by algebraic codebook.

2 Claims, 3 Drawing Sheets

U.S. PATENT DOCUMENTS

| | | | |
|---|---|---|---|
| 2002/0107686 | A1 | 8/2002 | Unno |
| 2002/0184010 | A1 | 12/2002 | Eriksson et al. |
| 2004/0181411 | A1 | 9/2004 | Gao |
| 2005/0065785 | A1 | 3/2005 | Bessette |
| 2006/0149540 | A1 | 7/2006 | Singh et al. |

FOREIGN PATENT DOCUMENTS

| | | |
|---|---|---|
| JP | 10-513571 | 12/1998 |
| JP | 11-501131 | 1/1999 |
| JP | 2006-504123 | 2/2006 |
| WO | 96/21221 | 7/1996 |
| WO | 96/24925 | 8/1996 |
| WO | 96/28810 | 9/1996 |
| WO | 2004/038924 | 5/2004 |

OTHER PUBLICATIONS

Yasunaga et al., "Dispersed-pulse codebook and its application to a 4 KB/S speech coder," Acoustics, Speech, and Signal Processing, 2000, ICASSP 2000, Proceedings 2000 IEEE International Conference on Jun. 5-9, 2000, Piscataway, NJ, USA, IEEE, vol. 3, Jun. 5, 2000, pp. 1503-1506.

Anonymous, "Project No. 3-0117-RV1, proposed creation of a new TIA Standard Source-Controlled Variable-Rate Multimode Wideband Speech Codec (VMR-WB), Service Options 62 and 63 for Spread Spectrum Systems," EIA/TIA Standard and Drafts, Telecummunications Inductry Association, Arlington, VA, U.S., Jan. 21, 2005.

ITU-T Recommendation G.729, "Coding of Speech at 8 kbits using Conjugate-structure Algebraic-Code-Excited Linear-Prediction (CS-ACELP)", Mar. 1996.

ITU-T Recommendation G.723.1, "Dual Rate Speech Coder for Multimedia Communications Transmitting at 5.3 and 6.3 kbit/s", Mar. 1996.

3GPP TS 26.090, "3rd Generation Partnership Project; Technical Specification Group Services and System Aspects; Mandatory Speech Codec speech processing functions; AMR speech codec; Trans-coding functions (Release 4) " V4.0.0, Mar. 2001.

R. Hagen et al., "Removal of Sparse—Excitation Artifacts in CELP", IEEE ICASSP 1998, pp. 145 to 148.

* cited by examiner

FIXED CODEBOOK SEARCHING APPARATUS AND FIXED CODEBOOK SEARCHING METHOD

CROSS-REFERENCE TO RELATED APPLICATION

This application is a continuation of pending U.S. patent application Ser. No. 11/683,830, filed Mar. 8, 2007, the disclosure of which is expressly incorporated herein by reference in its entirety.

This application claims priority of Japanese Patent Application Nos. 2006-065399, filed on Mar. 10, 2006, and 2007-027408, filed on Feb. 6, 2007, the disclosures of which are expressly incorporated by reference herein.

BACKGROUND OF THE INVENTION

1. Field of the Invention

The present invention relates to a fixed codebook searching apparatus and a fixed codebook searching method to be used at the time of coding by means of speech coding apparatus which carries out code excited linear prediction (CELP) of speech signals.

2. Description of the Related Art

Since the search processing of fixed codebook in a CELP-type speech coding apparatus generally accounts for the largest processing load among the speech coding processing, various configurations of the fixed codebook and searching methods of a fixed codebook have conventionally been developed.

Fixed codebooks using an algebraic codebook, which is broadly adopted in international standard codecs such as ITU-T Recommendation G.729 and G.723.1 or 3GPP standard AMR, or the like, is one of fixed codebooks that relatively reduce the processing load for the search (see Non-patent Documents 1 to 3, for instance). With these fixed codebooks, by making sparse the number of pulses generated from the algebraic codebook, the processing load required for fixed codebook search can be reduced. However, since there is a limit to the signal characteristics which can be represented by the sparse pulse excitation, there are cases that a problem occurs in the quality of coding. In order to address this problem, a technique has been proposed whereby a filter is applied in order to give characteristics to the pulse excitation generated from the algebraic codebook (see Non-Patent Document 4, for example).

Non-patent Document 1: ITU-T Recommendation G.729, "Coding of Speech at 8 kbit/s using Conjugate-structure Algebraic-Code-Excited Linear-Prediction (CS-ACELP)", March 1996.

Non-patent Document 2: ITU-T Recommendation G.723.1, "Dual Rate Speech Coder for Multimedia Communications Transmitting at 5.3 and 6.3 kbit/s", March 1996.

Non-patent Document 3: 3GPP TS 26.090, "AMR speech codec; Trans-coding functions" V4.0.0, March 2001.

Non-patent Document 4: R. Hagen et al., "Removal of sparse-excitation artifacts in CELP", IEEE ICASSP '98, pp. 145 to 148, 1998.

However, in the case that the filter applied to the excitation pulse cannot be represented by a lower triangular Toeplitz matrix (for instance, in the case of a filter having values at negative times in cases such as that of a cyclical convolution processing as described in Non-patent Document 4), extra memory and computational loads are required for matrix operations.

SUMMARY OF THE INVENTION

It is therefore an object of the present invention to provide speech coding apparatus which minimizes the increase in the computational loads, even if the filter applied to the excitation pulse has the characteristic that is unable to be represented by a lower triangular matrix, and to realize a quasi-optimal fixed codebook search.

The present invention attains the above-mentioned object using a fixed codebook searching apparatus provided with: a pulse excitation vector generating section that generates a pulse excitation vector; a first convolution operation section that convolutes an impulse response of a perceptually weighted synthesis filter in an impulse response vector which has one or more values at negative times, to generate a second impulse response vector that has one or more values at negative times; a matrix generating section that generates a Toeplitz-type convolution matrix by means of the second impulse response vector generated by the first convolution operation section; and a second convolution operation section that carries out convolution processing into the pulse excitation vector generated by the pulse excitation vector generating section using the matrix generated by the matrix generating section.

Also, the present invention attains the above-mentioned object by a fixed codebook searching method having: a pulse excitation vector generating step of generating a pulse excitation vector; a first convolution operation step of convoluting an impulse response of a perceptually weighted synthesis filter in an impulse response vector that has one of more values at negative times, to generate a second impulse response vector that has one or more values at negative times; a matrix generating step of generating a Toeplitz-type convolution matrix using the second impulse response vector generated in the first convolution operation step; and a second convolution operation step of carrying out convolution processing into the pulse excitation vector using the Toeplitz-type convolution matrix.

According to the present invention, the transfer function that cannot be represented by the Toeplitz matrix is approximated by a matrix created by cutting some row elements from a lower triangular Toeplitz matrix, so that it is possible to carry out the coding processing of speech signals with almost the same memory requirements and computational loads as in the case of a causal filter represented by a lower triangular Toeplitz matrix.

DETAILED DESCRIPTION OF THE PREFERRED EMBODIMENT

Features of the present invention include a configuration for carrying out fixed codebook search using a matrix created by trancating a lower triangular Toeplitz-type matrix by removing some row elements.

Hereinafter, a detailed description will be given on the embodiment of the present invention with reference to the accompanying drawings.

Embodiment

Figure 1:
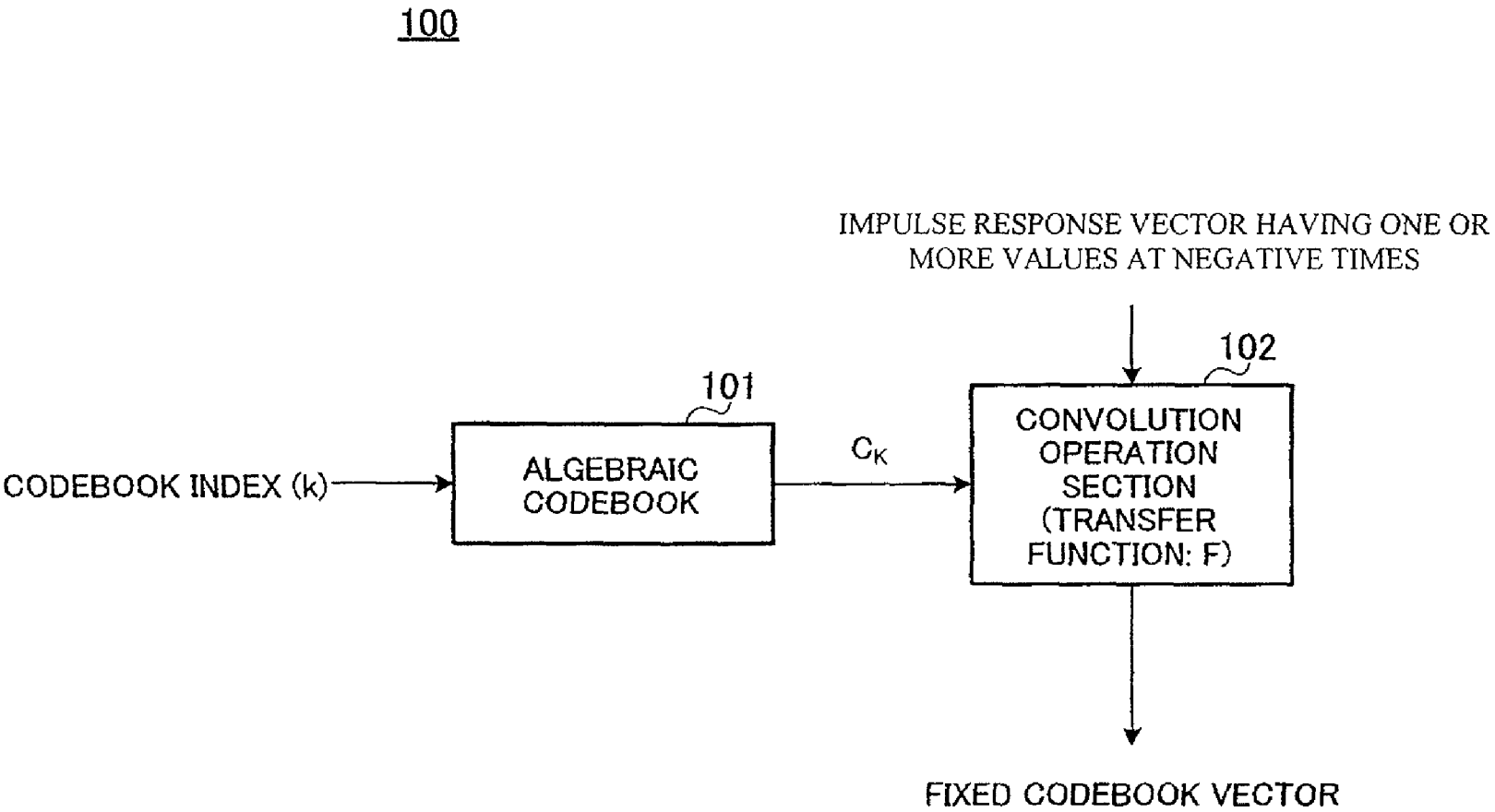
FIG. 1 is a block diagram showing a fixed codebook vector generating apparatus of a speech coding apparatus according to an embodiment of the present invention.

FIG. 1 is a block diagram showing a configuration of fixed codebook vector generating apparatus 100 of a speech coding apparatus according to an embodiment of the present invention. In the present embodiment, fixed codebook vector generating apparatus 100 is used as a fixed codebook of a CELP-type speech coding apparatus to be mounted and employed in a communication terminal apparatus such as a mobile phone, or the like.

Fixed codebook vector generating apparatus 100 has algebraic codebook 101 and convolution operation section 102.

Algebraic codebook 101 generates a pulse excitation vector $c_k$ formed by arranging excitation pulses in an algebraic manner at positions designated by codebook index k which has been inputted, and outputs the generated pulse excitation vector to convolution operation section 102. The structure of the algebraic codebook may take any form. For instance, it may take the form described in ITU-T recommendation G.729.

Convolution operation section 102 convolutes an impulse response vector, which is separately inputted and which has one or more values at negative times, with the pulse excitation vector inputted from algebraic codebook 101, and outputs a vector, which is the result of the convolution, as a fixed codebook vector. The impulse response vector having one or more values at negative times may take any shape. However, a preferable shape vector has the largest amplitude element at the point of time 0, and most of the energy of the entire vector is concentrated at the point of time 0. Also, it is preferable that the vector length of the non-causal portion (that is, the vector elements at negative times) is shorter than that of the causal portion including the point of time 0 (that is, the vector elements at nonnegative times) The impulse response vector which has one or more values at negative times may be stored in advance in a memory as a fixed vector, or it may also be a variable vector which is determined by calculation when needed. Hereinafter, in the present embodiment, a concrete description will be given of an example where an impulse response having one or more values at negative times, has values from time "−m" (in other words, all values are 0 prior to time "−m−1").

In FIG. 1, the perceptually weighted synthesis signal s, which is obtained by passing the pulse excitation vector $c_k$ generated from the algebraic codebook by referring the inputted fixed codebook index k, through convolution filter F (corresponding to convolution operation section 102 of FIG. 1) and un-illustrated perceptually weighted synthesis filter H, can be writer as the following equation (1):

$$s = HFc_k \qquad \text{(Equation 1)}$$

$$= \begin{bmatrix} h(0) & 0 & \dots & \dots & 0 \\ h(1) & h(0) & \ddots & & \vdots \\ \vdots & \vdots & \ddots & \ddots & \vdots \\ \vdots & \vdots & & \ddots & 0 \\ h(N-1) & h(N-2) & \dots & \dots & h(0) \end{bmatrix}$$

$$\begin{bmatrix} f(0) & \dots & f(-m) & 0 & 0 \\ f(1) & f(0) & \vdots & \ddots & 0 \\ \vdots & f(1) & f(0) & & f(-m) \\ \vdots & \vdots & \ddots & \ddots & \vdots \\ f(N-1) & f(N-2) & \dots & f(1) & f(0) \end{bmatrix} \begin{bmatrix} c_k(0) \\ c_k(1) \\ \vdots \\ \vdots \\ c_k(N-1) \end{bmatrix}$$

$$= \begin{bmatrix} \sum_{n=0}^{0} f(n)h(0-n) & \dots & \sum_{n=-m}^{-m} f(n)h(-m-n) & 0 & 0 \\ \sum_{n=0}^{1} f(n)h(1-n) & \ddots & \vdots & \ddots & 0 \\ \vdots & & \sum_{n=-m}^{0} f(n)h(0-n) & & \sum_{n=-m}^{-m} f(n)h(-m-n) \\ \vdots & & \vdots & \ddots & \vdots \\ \sum_{n=0}^{0} f(n)h(N-1-n) & \dots & \sum_{n=-m}^{N-1-M} f(n)h(N-1-m-n) & \dots & \sum_{n=-m}^{0} f(n)h(0-n) \end{bmatrix}$$

$$\begin{bmatrix} c_k(0) \\ c_k(1) \\ \vdots \\ \vdots \\ c_k(N-1) \end{bmatrix}$$

$$= \begin{bmatrix} h^{(m)}(0) & \dots & h^{(0)}(-m) & 0 & 0 \\ h^{(m)}(1) & \ddots & \vdots & \ddots & 0 \\ \vdots & & h^{(0)}(0) & & h^{(0)}(-m) \\ \vdots & & \vdots & \ddots & \vdots \\ h^{(m)}(N-1) & \dots & h^{(0)}(N-1-m) & \dots & h^{(0)}(0) \end{bmatrix} \begin{bmatrix} c_k(0) \\ c_k(1) \\ \vdots \\ \vdots \\ c_k(N-1) \end{bmatrix}$$

$$= H'' c_k$$

Here, h(n), where n=0, . . . , and N−1 shows the impulse response of the perceptually weighted synthesis filter, f(n), where n=−m, . . . , and N−1 show the impulse response of the non-causal filter (that is, the impulse response having one or more values at negative times), and $c_k(n)$, where n=0, . . . , and N−1 shows the pulse excitation vector designated by index k, respectively.

The search for the fixed codebook is carried out by finding k which maximizes the following equation (2). In equation (2), $c_k$ is the scalar product (or the cross-correlation) of the perceptually weighted synthesis signal s obtained by passing the pulse excitation vector $c_k$ designated by index k through the convolution filter F and the perceptually weighted synthesis filter H, and the target vector x to be described later, and $E_k$ is the energy of the perceptually weighted synthesis signal s obtained by passing $c_k$ through the convolution filter F and the perceptually weighted synthesis filter H (that is, $|s|^2$).

$$\frac{C_k^2}{E_k^2} = \frac{|x^t H'' c_k|^2}{c_k^t H''^t H'' c_k} = \frac{|d^t c_k|^2}{c_k^t \Phi c_k} = \frac{\left(\sum_{n=0}^{N-1} d(n) c_k(n)\right)^2}{c_k^t \Phi c_k} \quad \text{(Equation 2)}$$

x is called target vector in CELP speech coding and is obtained by removing the zero input response of the perceptually weighted synthesis filter from a perceptually weighted input speech signal. The perceptually weighted input speech signal is a signal obtained by applying the perceptually weighted filter to the input speech signal which is the object of coding. The perceptually weighted filter is an all-pole or pole-zero-type filter configured by using linear predictive coefficients generally obtained by carrying out linear prediction analysis of the input speech signal, and is widely used in CELP-type speech coding apparatus. The perceptually weighted synthesis filter is a filter in which the linear prediction filter configured by using linear predictive coefficients quantized by the CELP-type speech coding apparatus (that is, the synthesis filter) and the above-described perceptually weighted filter are connected in a cascade. Although these components are not illustrated in the present embodiment, they are common in CELP-type speech coding apparatus. For example, they are described in ITU-T recommendation G.729 as "target vector," "weighted synthesis filter" and "zero-input response of the weighted synthesis filter." Suffix "t" presents transposed matrix.

However, as can be understood from equation (1), the matrix H", which convolutes the impulse response of the perceptually weighted synthesis filter, which is convoluted with the impulse response that has one or more values at negative times, is not a Toeplitz matrix. Since the first to mth columns of matrix H" are calculated using columns in which part of or all of the non-causal components of the impulse response to be convoluted are truncated, they differ from the components of columns after the (m+1)th column which are calculated using all non-causal components of the impulse response to be convoluted, and therefore the matrix H" is not a Toeplitz matrix. For this reason, m kinds of impulse responses, from $h^{(1)}$ to $h^{(m)}$, must be separately calculated and stored, which results in an increase in the computational loads and memory requirement for the calculation of d and Φ.

Here, equation (2) is approximated by equation (3).

$$\frac{C_k^2}{E_k^2} = \frac{|x^t H'' c_k|^2}{c_k^t H''^t H'' c_k} \approx \frac{|x^t H' c_k|^2}{c_k^t H'^t H' c_k} = \frac{|d'^t c_k|^2}{c_k^t \Phi' c_k} = \frac{\left(\sum_{n=0}^{N-1} d'(n) c_k(n)\right)^2}{c_k^t \Phi' c_k} \quad \text{(Equation 3)}$$

Here, d'' is shown by the following equation (4).

$$d'^t = x^t H' = [x(0)x(1) \ldots \ldots x(N-1)] \begin{bmatrix} h^{(0)}(0) & \ldots & h^{(0)}(-m) & 0 & 0 \\ h^{(0)}(1) & \ddots & \vdots & \ddots & 0 \\ \vdots & & h^{(0)}(0) & & h^{(0)}(-m) \\ \vdots & & \vdots & \ddots & \vdots \\ h^{(0)}(N-1) & \ldots & h^{(0)}(N-1-m) & \ldots & h^{(0)}(0) \end{bmatrix} \quad \text{(Equation 4)}$$

In other words, d'(i) is shown by the following equation (5).

$$d'(i) = \begin{cases} \sum_{n=-i}^{N-1-i} x(n+i) h^{(0)}(n), & \text{where } i = 0, \ldots, m-1 \\ \sum_{n=-m}^{N-1-i} x(n+i) h^{(0)}(n), & \text{where } i = m, \ldots, N-1 \end{cases} \quad \text{(Equation 5)}$$

Here, x(n) shows the nth element of the target vector (n=0, 1, . . . , N−1; N being the frame or the sub-frame length which is the unit time for coding of the excitation signal), $h^{(0)}(n)$ shows element n (n=−m, 0, . . . , N−1) of the vector obtained by convoluting the impulse response which has one or more values at negative times with an impulse response of the perceptually weighted filter, respectively. The target vector is a vector which is commonly employed in CELP coding and is obtained by removing the zero-input response of the perceptually weighted synthesis filter from the perceptually weighted input speech signal. $h^{(0)}(n)$ is a vector obtained by applying a non-causal filter (impulse response f(n), n=−m, . . . , 0, . . . , N−1) to the impulse response h(n) (n=0, 1, . . . , N−1) of the perceptually weighted synthesis filter, and is shown by the following equation (6). $h^{(0)}(n)$ also becomes an impulse response of a non-causal filter (n=−m, . . . , 0, . . . , N−1).

$$h^{(0)}(i) = \sum_{n=-m}^{i} f(n)h(i-n),\ i = -m, \ldots, N-1 \quad \text{(Equation 6)}$$

Also, matrix Φ' is shown by the following equation (7).

$$\Phi' = H''H' \quad \text{(Equation 7)}$$

$$= \begin{bmatrix} h^{(0)}(0) & \ldots & h^{(0)}(m) & \ldots & h^{(0)}(N-1) \\ \vdots & \ddots & \vdots & & \vdots \\ h^{(0)}(-m) & \ldots & h^{(0)}(0) & \ldots & h^{(0)}(N-1-m) \\ 0 & \ddots & \vdots & \ddots & \vdots \\ 0 & 0 & h^{(0)}(-m) & \ldots & h^{(0)}(0) \end{bmatrix} \begin{bmatrix} h^{(0)}(0) & \ldots & h^{(0)}(-m) & 0 & 0 \\ \vdots & \ddots & \vdots & \ddots & 0 \\ h^{(0)}(m) & \ldots & h^{(0)}(0) & & h^{(0)}(-m) \\ \vdots & & \vdots & \ddots & \vdots \\ h^{(0)}(N-1) & \ldots & h^{(0)}(N-1-m) & \ldots & h^{(0)}(0) \end{bmatrix}$$

In other words, each element φ'(i, j) of matrix Φ' is shown by the following equation (8).

$$\phi'(i, j) = \begin{cases} \sum_{n=-i}^{N-1-i} h^{(0)}(n)h^{(0)}(n), & \text{where } i = j = 0, \ldots, m-1 \\ \phi'(j, i) = \sum_{n=-m}^{N-1-j} h^{(0)}(n+j-i)h^{(0)}(n), & \text{where } i = m, \ldots, N-1,\ j = i, \ldots N-1 \end{cases} \quad \text{(Equation 8)}$$

More specifically, the matrix H" becomes a matrix H' by approximating the pth column element $h^{(p)}(n)$, p=1 to m, with another column element $h^{(0)}(n)$. This matrix H' is a Toeplitz matrix, in which row elements of a lower triangular Toeplitz-type matrix are truncated. Even if such approximation is introduced, when the energy of the non-causal elements (components at negative times) is sufficiently small as compared to the energy of causal elements (components at non-negative times, in other words, at positive times, including time 0) in the impulse response vector having one or more values at negative times, the influence of approximation is insignificant. Also, since the approximation is introduced only to the elements of the first column to the mth column of matrix H" (here m is the length of the non-causal elements), the shorter m becomes, the more negligible the influence of the approximation becomes.

On the other hand, there is a large difference between matrix Φ' and matrix Φ in the computational loads of calculating them, that is, a large difference appears depending on whether the approximation of equation (3) is used or not used. For instance, in comparison to the case of determining matrix $\Phi_0 = H'H$ (H is a lower triangular Toeplitz matrix which convolutes the impulse response of the perceptually weighted filter in equation (1)) in a common algebraic codebook which convolute the impulse response which has no value at negative times, the m-times product-sum operations basically increase in calculating matrix Φ' by using the approximation of equation (3), as understood from equation (8). Also, as is performed with the C code of ITU-T recommendation G.729, φ'(i, j) can be recursively calculated for the elements where (j−i) is constant (for instance, φ'(N−2, N−1), φ'(N−3, N−2), . . . , φ'(0, 1)). This special feature realizes efficient calculations of elements of matrix Φ', which means that m-times product-sum operations are not always added to the calculation of elements of matrix Φ'.

On the other hand, in the calculation of matrix φ, in which the approximation of equation (3) is not used, unique correlation calculations need to be carried out for calculating the elements φ(p, k)=φ(k, p), where p=0, . . . , m, k=0, . . . , N−1. That is, impulse response vectors used for these calculations differ from the impulse response vector used for calculations of other elements of matrix Φ (in other words, determine not the correlation of $h^{(0)}$ and $h^{(0)}$, but the correlation of $h^{(0)}$ and $h^{(p)}$, p=1 to m). These elements are elements whose calculation results are obtained towards the end of the recursive determination. In other words, the advantage that "elements can be recursively determined, and therefore the elements of matrix Φ can be efficiently calculated", as described above, is lost. This means that the amount of operation increases approximately in proportion to the number of non-causal elements of the impulse response vector having one or more values at negative times (for instance, the amount of operation nearly doubles even in the case m=1).

Figure 2:
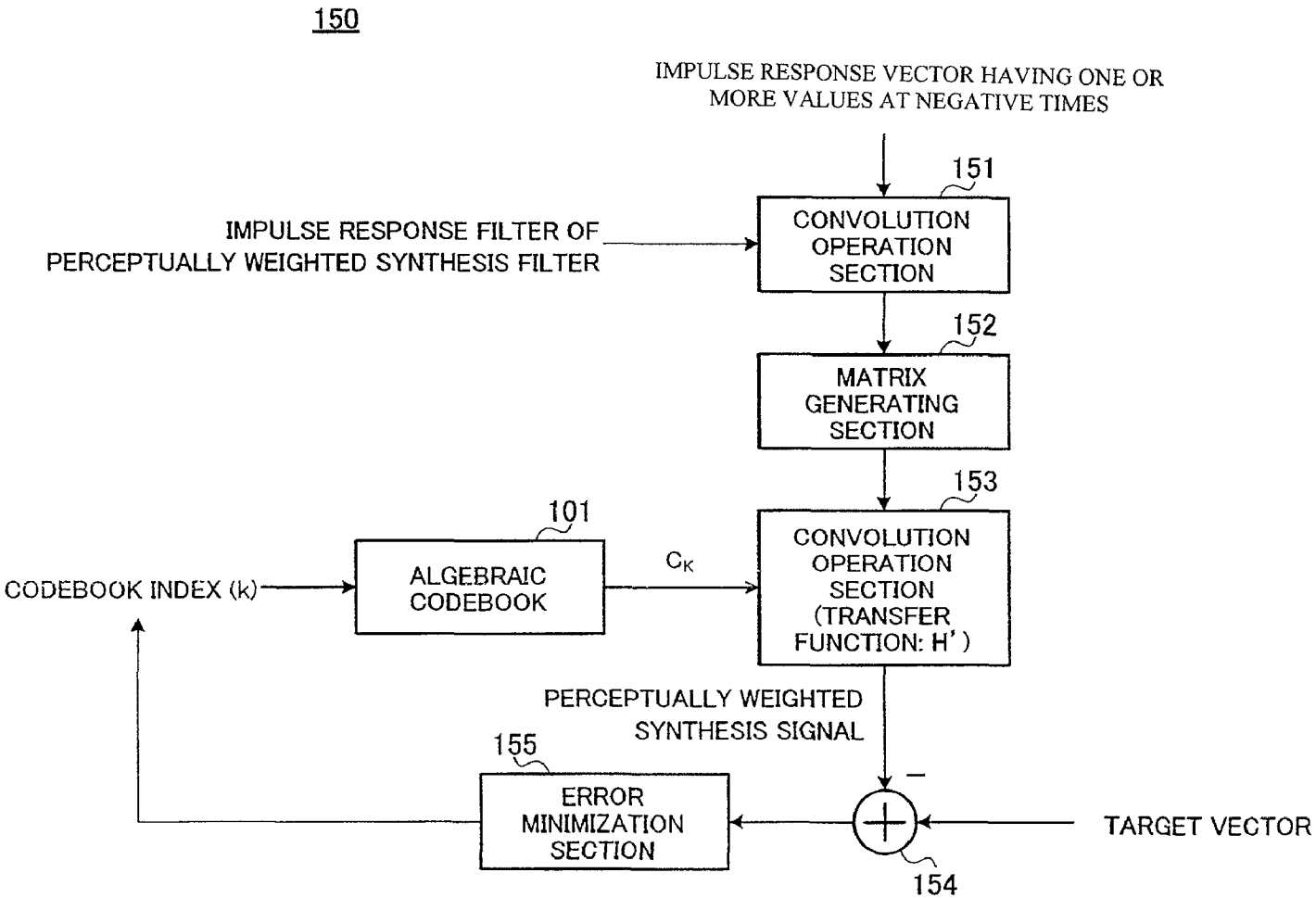
FIG. 2 is a block diagram showing an example of a fixed codebook searching apparatus of a speech coding apparatus according to an embodiment of the present invention.

FIG. 2 is a block diagram showing one example of a fixed codebook searching apparatus 150 that accomplishes the above-described fixed codebook searching method.

The impulse response vector which has one or more values at negative times and the impulse response vector of the perceptually weighted synthesis filter are inputted to convolution operation section 151. Convolution operation section 151 calculates $h^{(0)}(n)$ by means of equation (6), and outputs the result to matrix generating section 152.

Matrix generating section 152 generates matrix H' using $h^{(0)}(n)$, inputted by convolution operation section 151, and outputs the result to convolution operation section 153.

Convolution operation section 153 convolutes the element $h^{(0)}(n)$ of matrix H' inputted by matrix generating section 152 with a pulse excitation vector $c_k$ inputted by algebraic codebook 101, and outputs the result to adder 154.

Adder 154 calculates a differential signal of the perceptually weighted synthesis signal inputted from convolution operation section 153 and a target vector which is separately inputted, and outputs the result to error minimization section 155.

Error minimization section 155 specifies the codebook index k for generating pulse excitation vector $C_k$ at which the energy of the differential signal inputted from adder 154 becomes minimum.

Figure 3:
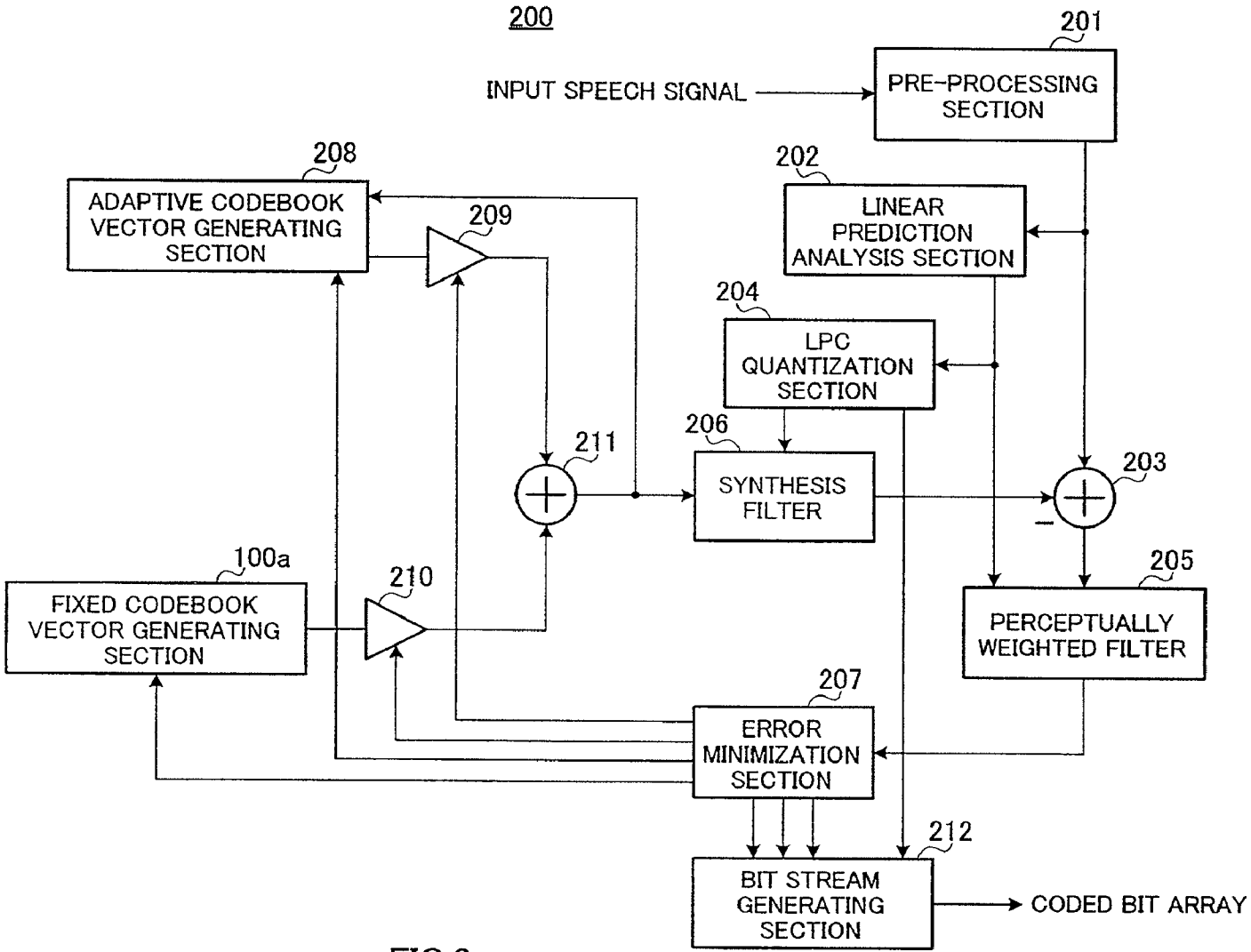
FIG. 3 is a block diagram showing an example of a speech coding apparatus according to an embodiment of the present invention.

FIG. 3 is a block diagram showing a configuration of a generic CELP-type speech coding apparatus 200 which is provided with fixed codebook vector generating apparatus 100 shown in FIG. 1, as a fixed codebook vector generating section 100*a*.

The input speech signal is inputted to pre-processing section 201. Pre-processing section 201 carries out pre-processing such as removing the direct current components, and outputs the processed signal to linear prediction analysis section 202 and adder 203.

Linear prediction analysis section 202 carries out linear prediction analysis of the signal inputted from pre-processing section 201, and outputs linear predictive coefficients, which are the result of the analysis, to LPC quantization section 204 and perceptually weighted filter 205.

Adder 203 calculates a differential signal of the input speech signal, which is obtained after pre-processing and inputted from pre-processing section 201, and a synthes is speech signal inputted from synthesis filter 206, and outputs the result to perceptually weighted filter 205.

LPC quantization section 204 carries out quantization and coding processing of the linear predictive coefficients inputted from linear prediction analysis section 202, and respectively outputs the quantized LPC to synthesis filter 206, and the coding results to bit stream generating section 212.

Perceptually weighted filter 205 is a pole-zero-type filter which is configured using the linear predictive coefficients inputted from linear prediction analysis section 202, and carries out filtering processing of the differential signal of the input speech signal, which is obtained after pre-processing and inputted from adder 203, and the synthesis speech signal, and outputs the result to error minimization section 207.

Synthesis filer 206 is a linear prediction filter constructed by using the quantized linear predictive coefficients inputted by LPC quantization section 204, and receives as input a driving signal from adder 211, carries out linear predictive synthesis processing, and outputs the resulting synthesis speech signal to adder 203.

Error minimization section 207 decides the parameters related to the gain with respect to the adaptive codebook vector generating section 208, fixed codebook vector generating section 100*a*, adaptive codebook vector and fixed codebook vector, such that the energy of the signal inputted by perceptually weighted filter 205 becomes minimum, and outputs these coding results to bit stream generating section 212. In this block diagram, the parameters related to the gain are assumed to be quantized and resulted in obtaining one coded information within error minimization section 207. However, a gain quantization section may be outside error minimization section 207.

Adaptive codebook vector generating section 208 has an adaptive codebook which buffers the driving signals inputted from adder 211 in the past, generates an adaptive codebook vector and outputs the result to amplifier 209. The adaptive codebook vector is specified according to instructions from error minimization section 207.

Amplifier 209 multiplies the adaptive codebook gain inputted from error minimization section 207 by the adaptive codebook vector inputted from adaptive codebook vector generating section 208 and outputs the result to adder 211.

Fixed codebook vector generating section 10*a* has the same configuration as that of fixed codebook vector generating apparatus 100 shown in FIG. 1, and receives as input information regarding the codebook index and impulse response of the non-causal filter from error minimization section 207, generates a fixed codebook vector and outputs the result to amplifier 210.

Amplifier 210 multiplies the fixed codebook gain inputted from error minimization section 207 by the fixed codebook vector inputted from fixed codebook vector generating section 100*a* and outputs the result to adder 211.

Adder 211 sums up the gain-multiplied adaptive codebook vector and fixed codebook vector, which are inputted from adders 209 and 210, and outputs the result, as a filter driving signal, to synthesis filter 206.

Bit stream generating section 212 receives as input the coding result of the linear predictive coefficients (that is, LPC) inputted by LPC Quantization section 204, and receives coding results of the adaptive codebook vector and fixed codebook vector and the gain information for them, which have been inputted from error minimization section 207, and converts them to a bit stream and outputs the bit stream.

When deciding the parameters of the fixed codebook vector in error minimization section 207, the above-described fixed codebook searching method is used, and a device such as the one described in FIG. 2 is used as the actual fixed codebook searching apparatus.

In this way, in the present embodiment, in the case a filter having impulse response characteristic of having one or more values at negative times (generally called non-causal filter) is applied to an excitation vector generated from an algebraic codebook, the transfer function of the processing block in which the non-causal filter and the perceptually weighted synthesis filer are connected in a cascade is approximated by a lower triangular Toeplitz matrix in which the matrix elements are truncated only by the number of rows of the length of the non-causal portion. This approximation makes it possible to suppress an increase in the computational loads required for searching the algebraic codebook. Also, in the case the number of non-causal elements is lower than the number of causal elements, and/or if the energy of the non-causal elements is lower than the energy of the causal elements, the influence of the above-mentioned approximation on the quality of the coding can be suppressed.

The present embodiment may be modified or used as described in the following.

The number of causal components in the impulse response of the non-causal filter may be limited to a specified number within a range in which it is larger than the number of non-causal components.

In the present embodiment, a description was given only on the processing at the time of fixed codebook search.

In the CELP-type speech coding apparatus, gain quantization is usually carried out after fixed codebook search.

Since the fixed excitation codebook vector that has passed through the perceptually weighted synthesis filter (that is, the synthesis signal obtained by passing the selected fixed excitation codebook vector through the perceptually weighted synthesis filter) is required at this time, it is common to calculate this "fixed excitation codebook vector that has passed through the perceptually weighted synthesis filter" after the fixed codebook search is finished. The impulse response convolution matrix to be used at this time is not the impulse response convolution matrix $H^{(0)}$ for approximation, which has been used at the time of search, but, preferably, the matrix H" in which only the elements of the first to mth columns (=the case the number of non-causal elements is m) differ from the other elements.

Also, in the present embodiment, it was described that the vector length in the non-causal portion (that is, the vector elements at negative times) is preferably shorter than the causal portion including time 0 (that is, the vector elements at non-negative times). However, the length of the non-causal portion is set to less than N/2 (N is the length of the pulse excitation vector).

In the above, a description has been given of the embodiment of the present invention.

The fixed codebook searching apparatus and the speech coding apparatus according to the present invention are not limited to the above-described embodiment, and they can be modified and embodied in various ways.

The fixed codebook searching apparatus and the speech coding apparatus according to the present invention can be mounted in communication terminal apparatus and base station apparatus in mobile communication systems, and this makes it possible to provide communication terminal apparatus, base station apparatus and mobile communications systems which have the same operational effects as those described above.

Also, although an example has been described here of a case where the present invention is configured in hardware, the present invention can also be realized by means of software. For instance, the algorithm of the fixed codebook searching method and the speech coding method according to the present invention can be described by a programming language, and by storing this program in a memory and executing the program by means of an information processing section, it is possible to implement the same functions as those of the fixed codebook searching apparatus and speech coding apparatus of the present invention.

The terms "fixed codebook" and "adaptive codebook" used in the above-described embodiment may also be referred to as "fixed excitation codebook" and "adaptive excitation codebook".

Each function block employed in the description of each of the aforementioned embodiments may typically be implemented as an LSI constituted by an integrated circuit. These may be individual chips or partially or totally contained on a single chip.

"LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology. Application in biotechnology is also possible.

The fixed codebook searching apparatus of the present invention has the effect that, in the CELP-type speech coding apparatus which uses the algebraic codebook as fixed codebook, it is possible to add non-causal filter characteristic to the pulse excitation vector generated from the algebraic codebook, without an increase in the memory size and a large computational loads, and is useful in the fixed codebook search of the speech coding apparatus employed in communication terminal apparatus such as mobiles phones where the available memory size is limited and where radio communication is forced to be carried out at low speed.

What is claimed is:

1. A fixed codebook searching apparatus, comprising:

a convolution operator, implemented by at least one processor, that convolves an impulse response of a perceptually weighted synthesis filter with an impulse response vector that has values at negative times, to generate a second impulse response vector that has values at negative times;

a matrix generator, implemented by the at least one processor, that generates a Toeplitz-type convolution matrix using the second impulse response vector generated by the convolution operator; and a searcher, implemented by the at least one processor, that performs a codebook search by maximizing a term using the Toeplitz-type convolution matrix, wherein a time length of negative time elements of the second impulse response vector is shorter than a time length of nonnegative time elements.

2. The fixed codebook searching apparatus according to claim 1, wherein the second impulse response vector comprises one negative time element.

* * * * *